US007009516B2

(12) United States Patent
Enea

(10) Patent No.: US 7,009,516 B2
(45) Date of Patent: Mar. 7, 2006

(54) ELECTRONIC SENSOR SYSTEM FOR MONITORING ACTIVITY OF OBJECTS

(75) Inventor: Bruno Enea, Mudaison (FR)

(73) Assignee: D.I.P.O. SA, Clapiers (FR)

( * ) Notice: Subject to any disclaimer, the term of this patent is extended or adjusted under 35 U.S.C. 154(b) by 0 days.

(21) Appl. No.: 10/273,740

(22) Filed: Oct. 18, 2002

(65) Prior Publication Data

US 2003/0093247 A1 May 15, 2003

Related U.S. Application Data

(63) Continuation-in-part of application No. 09/623,997, filed as application No. PCT/FR99/00582 on Mar. 12, 1999, now abandoned.

(30) Foreign Application Priority Data

Mar. 12, 1998 (FR) ..... 98 03412

(51) Int. Cl.
*G08B 13/14* (2006.01)

(52) U.S. Cl. ..... 340/572.1; 340/539.13; 340/573.1

(58) Field of Classification Search ..... 340/572.1, 340/539.13, 573.4, 573.1, 3.1, 10.52, 7.46, 340/539.26–539.29, 539.3, 10.33, 10.1, 10.2, 340/7.33, 7.32, 7.35, 7.36
See application file for complete search history.

(56) References Cited

U.S. PATENT DOCUMENTS

| | | | | | |
|---|---|---|---|---|---|
| 5,086,290 | A | * | 2/1992 | Murray et al. | 340/539.13 |
| 5,214,409 | A | * | 5/1993 | Beigel | 340/572.1 |
| 5,395,218 | A | * | 3/1995 | Thompson | 417/416 |
| 5,461,365 | A | * | 10/1995 | Schlager et al. | 340/573.4 |
| 5,661,460 | A | * | 8/1997 | Sallen et al. | 340/573.4 |
| 5,887,176 | A | * | 3/1999 | Griffith et al. | 713/320 |
| 6,104,285 | A | * | 8/2000 | Stobbe | 340/505 |
| 6,122,494 | A | * | 9/2000 | Tuttle | 455/193.1 |
| 6,127,931 | A | * | 10/2000 | Mohr | 340/573.4 |
| 6,137,411 | A | * | 10/2000 | Tyren | 340/572.1 |
| 6,154,136 | A | * | 11/2000 | Van Eeden | 340/572.1 |
| 6,166,642 | A | * | 12/2000 | Farshid | 340/573.1 |

* cited by examiner

*Primary Examiner*—Phung T. Nguyen
(74) *Attorney, Agent, or Firm*—Egbert Law Offices

(57) ABSTRACT

An electronic sensor system for monitoring activity of objects according to the invention is of the type includes a central electronic unit exchanging encoded information through radio frequencies with at least one transponder, associated with an object to be monitored, in order to check for activity, such as its presence in a defined volume, and emitting an alarm when said encoded information received from the transponder directs the central electronic unit to start the alarm. The central electronic unit selectively corresponds with each transponder in the system and controls whether the transponder operates in stand-by mode or an active phase mode.

13 Claims, 7 Drawing Sheets

Figure 1 Legend

1 - central unit
10 - exchange of information
11 - transponder
12 - defined volume
13 - alarm

Figure 2 Legend

20 - transmission/reception circuit
20' - interface
21 - antenna
22 - microprocessor
23 - read-only memory
23' - random access memory
24 - buzzer
25 - LED
30 - microcontroller
31 - transmission/reception circuit
32 - antenna
33 - memory
34 - time counter
34' - time counter

| | Activity bit |
|---|---|
| Tr1 | 1 |
| Tr2 | 1 |
| Tr3 | 0 |
| Tr4 | 1 |
| Tr5 | 0 |
| Tr6 | 0 |
| Tr7 | 1 |

ELECTRONIC SENSOR SYSTEM FOR MONITORING ACTIVITY OF OBJECTS

RELATED U.S. APPLICATIONS

The present invention is a continuation-in-part application of U.S. patent application Ser. No. 09/623,997, filed on Sep. 12, 2000, abandoned by the present inventor, entitled "ELECTRONIC SENSOR FOR IDENTIFYING OBJECTS TO PREVENT THEM FROM BEING LOST, STOLEN OR MOVED".

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The invention relates to an electronic sensor system, in particular, an electronic sensor system for detecting activity of objects, such as temperature, balance, or presence in a zone.

BACKGROUND OF THE INVENTION

Several devices are currently known which monitor the presence of objects in a determined zone, such as the one described in U.S. Pat. No. 5,396,218 comprising a master card and at least one slave card or transponder, designed to be placed in the object to be monitored. The cards are adapted to exchange information between them through radio-frequencies, wherein the master card forms the central control system including an alarm circuit which is activated when the slave card leaves the field of protection.

German Patent No. 3,618,416 relates to an electronic device for monitoring luggage or other objects, comprising a central electronic unit exchanging encoded information with secondary units or transponders, that can be placed in the objects to be monitored or made integral with the latter. The central unit is programmable according to the number of secondary units, the level of reception, or other parameters, and transmits call signals to the secondary units responding to the central unit that trigger an alarm according to the signals received.

However, in these devices, the electronic circuits of the secondary units are permanently activated, which brings up the problem of power consumption and therefore of autonomy, in particular when small-sized secondary units, or transponders, are used with signal transmissions at high frequencies, higher than approximately 400 MHz, requiring a considerable power consumption to obtain a homogenous covering of transmissions/receptions within a volume of several meters of a spherical or delta type. On the other hand, these devices have an integrated power supply that can be neither recharged nor replaced. Besides, these devices oblige the user to activate and deactivate all transponders if he wishes to stop or re-activate the system, when he is at his working place or at home or some other place not requiring protection, which is inconvenient, since this intervention has to be performed several times a day.

On the other hand, these devices do not provide signaling in case a supernumerary unit with the same encoding is inserted into the protection field of the device for the purpose of maleficent substitution of a protected secondary unit.

BRIEF SUMMARY OF THE INVENTION

One of the problems to be solved is therefore the creation of a system for monitoring activity of objects using small-size transponders capable of covering effectively a defined volume with exchange of information between the transponders and the central unit in a high-frequency band. The monitored activity of the objects may include temperature changes, movement, equilibrium and presence of the objects in a defined volume.

This invention is aimed at coping with these inconveniences by proposing a system for the detection of activity of objects by means of small-size transponders providing a considerable autonomy of use and enabling an easy calibration and operation of the system and insuring a secure functioning.

The electronic sensor system for monitoring activity of objects according to the invention is of the type comprising a central electronic unit exchanging encoded information through radio frequencies with at least one transponder, associated with an object to be monitored, in order to check for activity, such as its presence in a defined volume, and emitting an alarm when said encoded information received from the transponder directs the central electronic unit to start the alarm. For example, an object having a transponder with a sensor is placed in a defined volume and transmits notification of its presence in the defined volume. If the object is removed or stolen from the defined volume, the missing transponder is recognized by the central electronic unit, which sounds an alarm. Another example is a transponder with a temperature sensor placed on a chemical vat, which transmits encoded temperature information to the central electronic unit. If the temperature information indicates an elevated temperature, then the central electronic unit may direct an alarm to issue.

Each transponder has a stand-by mode and active phase mode. The transponder normally functions in stand-by mode without receiving or transmitting encoded information to the central electronic unit. The transponder uses a power source to maintain an active timer, and at regular intervals, the transponder shifts into an active phase mode to transmit and receive encoded information. In comparison to prior art passive tags, which take the energy necessary for their operation from the RF field received and require considerable transmission power, the transponders of the present invention are capable of operating with a reduced RF field. The transmission power from the central electronic unit of the present invention may be set at less than 1 mW. The stand-by mode also allows the electronic sensor system to easily re-synchronize the transponders. As each transponder shifts into active phase mode, the central electronic unit corresponds selectively with each transponder and may transmit updated information to reset the timing or re-calibrate the temperature. Thus, each transponder may function with autonomy.

An active phase mode corresponds to an active state of reception and processing of signals of encoded information sent between the central electronic unit and each transponder. In the active phase mode, encoded information can be sent and responsive information may be received. For example, the signal sent by the central electronic unit can be a signal of verifying presence, and the signal of response sent by the transponder can be an encoded message of confirmation of the presence from the transponder in the monitored volume.

The relation between the duration of an active phase mode and the duration of the operating cycle in stand-by mode shall be very small and, preferably, lower than 10%, in order to provide the transponders with large power autonomy.

The central electronic unit is comprised of a transmission/reception circuit, an interface comprising a buffer memory enabling the radio-frequency connection between the central electronic unit and several transponders, a microcontroller, a microprocessor and memory storage containing the algorithms, in the form of computer programs, of the different modes of operation of the sensor. The microprocessor functions to process the encoded information from a transponder, such as interrogating a transponder for location in a defined volume or receiving temperature of the transponder. The central electronic unit may activate the alarm, depending upon the information received.

The central electronic unit corresponds in a selective way with each transponder. While interrogating a transponder reporting abnormal activity, the central electronic unit may acknowledge the encoded information and maintain the transponder in active phase mode, instead of allowing the transponder to return to stand-by mode. Also, the central electronic unit may switch all other transponders into extended stand-by mode to allow extended contact between the central electronic unit and the transponder with abnormal activity. The central electronic unit may re-calibrate the entire system, once action has been taken to resolve the abnormal activity.

The transponders include, in a first embodiment, a sensor means, a power source, a microprocessor, a microcontroller and memory storage, a transmission/reception circuit and an interface comprising a buffer memory enabling connection with several controllers.

The transponders include, in a second embodiment, a transmission/reception circuit and an intelligent memory capable, upon receipt of an impulse sent by the central unit, of sending, via said transmission/reception circuit, an encoded information contained in its memory to the central unit.

According to the invention, the electronic sensor system comprises

- a calibration mode in which the central electronic unit sets the initial activity level of the objects, such as detecting the transponders located in its monitored volume and identifying them in its memory among the transponders referenced in it,
- a protection mode in which the central electronic unit queries successively in a loop the transponders referenced and identified in its memory and transmits an alarm if a change in activity exceeds pre-set parameters, such as one of said transponders failing to report its location in its monitored volume, and
- a detection mode in which the central electronic unit queries successively in a loop the referenced transponders and triggers an alarm the moment one of said transponders responds with certain encoded information, going on, until the intervention of the user or until the central electronic unit has detected all said transponders, such as receiving a temperature reading that is too high.

The electronic sensor system according to this invention can, in addition, include an initialization mode for introducing new transponders and, thus, for modifying the memory of the central electronic unit for referencing of the transponders. This mode uses the time provided in the beginning of an interrogation frame for the transponders, in order to initialize the new transponder and reference it in the memory, with a view to its identification and its monitoring, the other referenced and identified transponders being, in this mode, and during this time interval, in stand-by.

The electronic sensor system according to the invention can also include an erasing mode permitting erasure from the memory any transponder the user does not want to keep.

The central electronic unit can advantageously include means like signal lamps or an alphanumeric display to inform the user in each mode of operation of the transponder, for example in the case of inserting a new transponder, confirming that the latter has been referenced in the memory of the central electronic unit, then identified to be monitored.

According to the invention, each of the transponders is capable of being integrated in an object to be monitored or appear, each, in the form of an electronic label that can be made integral with said object and each transponder is supplied with power autonomously or by the central electronic unit.

The advantages and the characteristics of this invention will be made more evident by the following description referring to the attached drawings, which represent several non-restrictive embodiments of the same.

DETAILED DESCRIPTION OF THE INVENTION

The present invention is shown in an embodiment of monitoring objects for presence in a defined volume. It is important to note that multiple activities, such as temperature, equilibrium and motion may also be monitored under the present invention.

Figure 1:
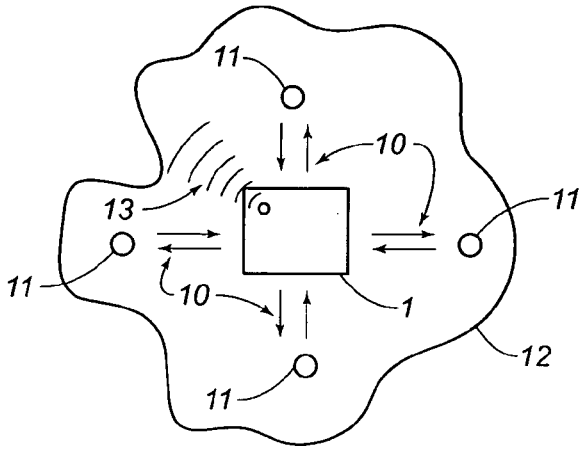
FIG. 1 is a schematic view of the device according to the invention.

In FIG. 1, one can see that a device for the detection of objects includes a central unit 1 exchanging information 10 with transponders 11, each associated with an object, not shown, for the purpose of controlling their presence in a defined volume 12.

The central unit 1 thus controls the communications of verification of the presence of the transponders 11 in the monitored volume 12 and, in case of absence of one of them, triggers a sound alarm 13.

Figure 2:
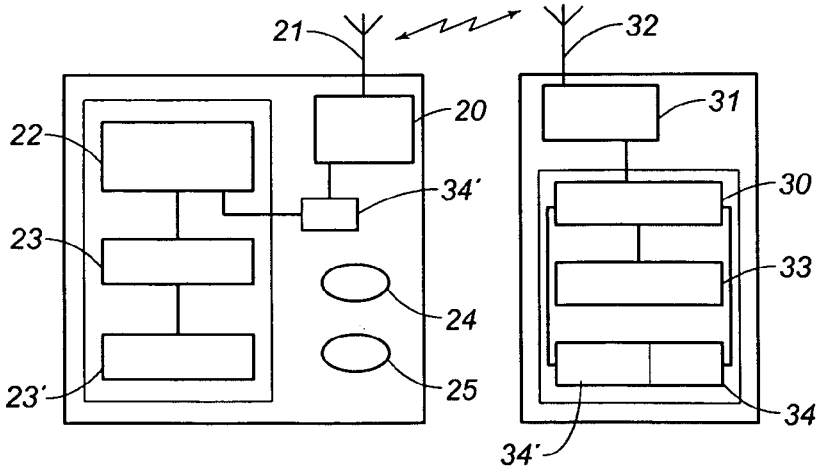
FIG. 2 is an illustration of the functional diagram of the central unit and a transponder.

As shown in FIG. 2, a central unit 1 includes a transmission/reception circuit 20, connected to an antenna 21, connected to an interface 20' enabling the connection with several transponders 11, and a microcontroller 22 connected, on the one hand, to the interface 20' and, on the other hand, to a read-only memory 23 containing the computer program integrating the algorithms of the various modes of operation (shown in FIGS. 4*a* through 4*e*) of the device, and a random access memory 23' for containing parameters inherent to the transponders 11, a buzzer 24 for the emission of the sound alarm 13 and one or several LEDs 25 for the emission of a light alarm signal to provide the user with information on the functioning of the device.

Each transponder 11 is comprised of a microcontroller 30 connected to a transmission/reception circuit 31, connected to an antenna 32, and to memories 33, containing the characteristics of the transponder 11 and in particular encoded information aimed at being sent to the central unit at its request, and two time counters 34, 34'.

The transmitter of the transmission/reception circuits 20, 31 includes, not shown, a digital data input and a transmission circuit for transmitting preferably digital information, in a frequency range higher than approx. 400 MHz, at distances in the range of several meters and in particular from 1 to approx. 120 in. As to the receiver, it can use a structure of the superheterodyne type with two mixers to recover information coming from the central unit either in analog form or in digital form. It can also be adapted to transmit a signal of detection of carrier indicating that a reception is about to take place.

Figures 3A, 3B:
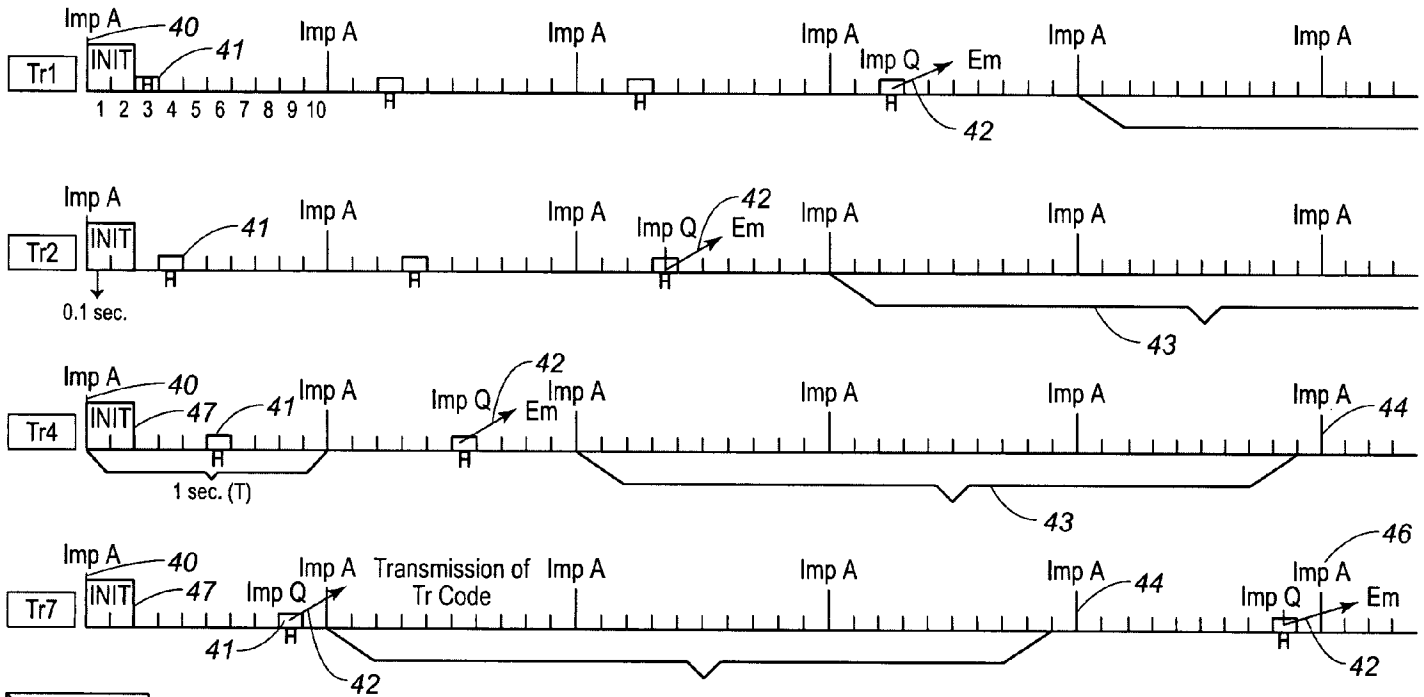
FIG. 3*a* is an illustration of the state of the registers of the memory of the central unit for a particular case of operation of the device according to the invention.
FIG. 3*b* is an illustration of the time diagram in protection mode of the device according to the invention.
Figure 4A:
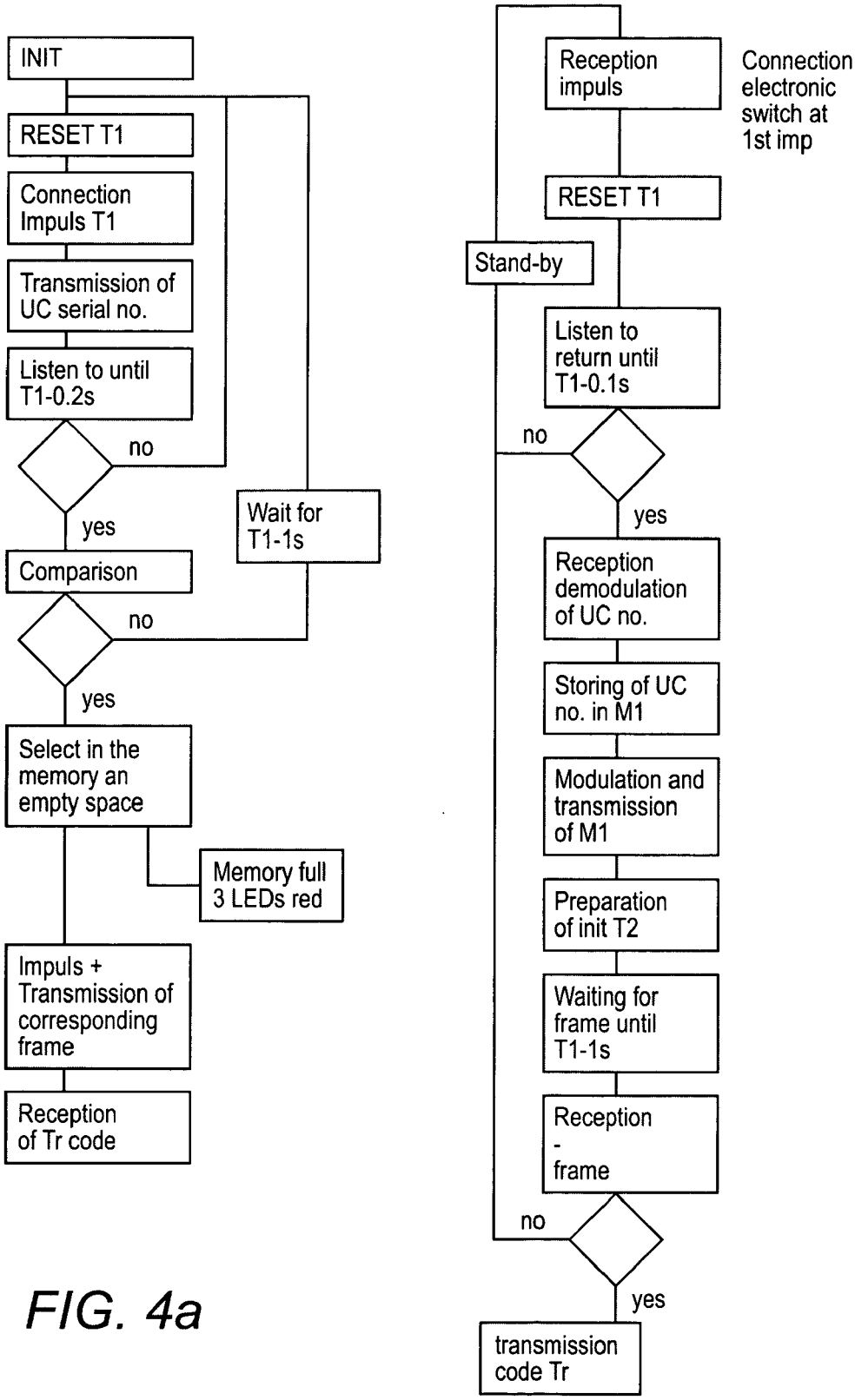
FIG. 4*a* is an illustration of an algorithm of the initialization mode.
Figure 4B:
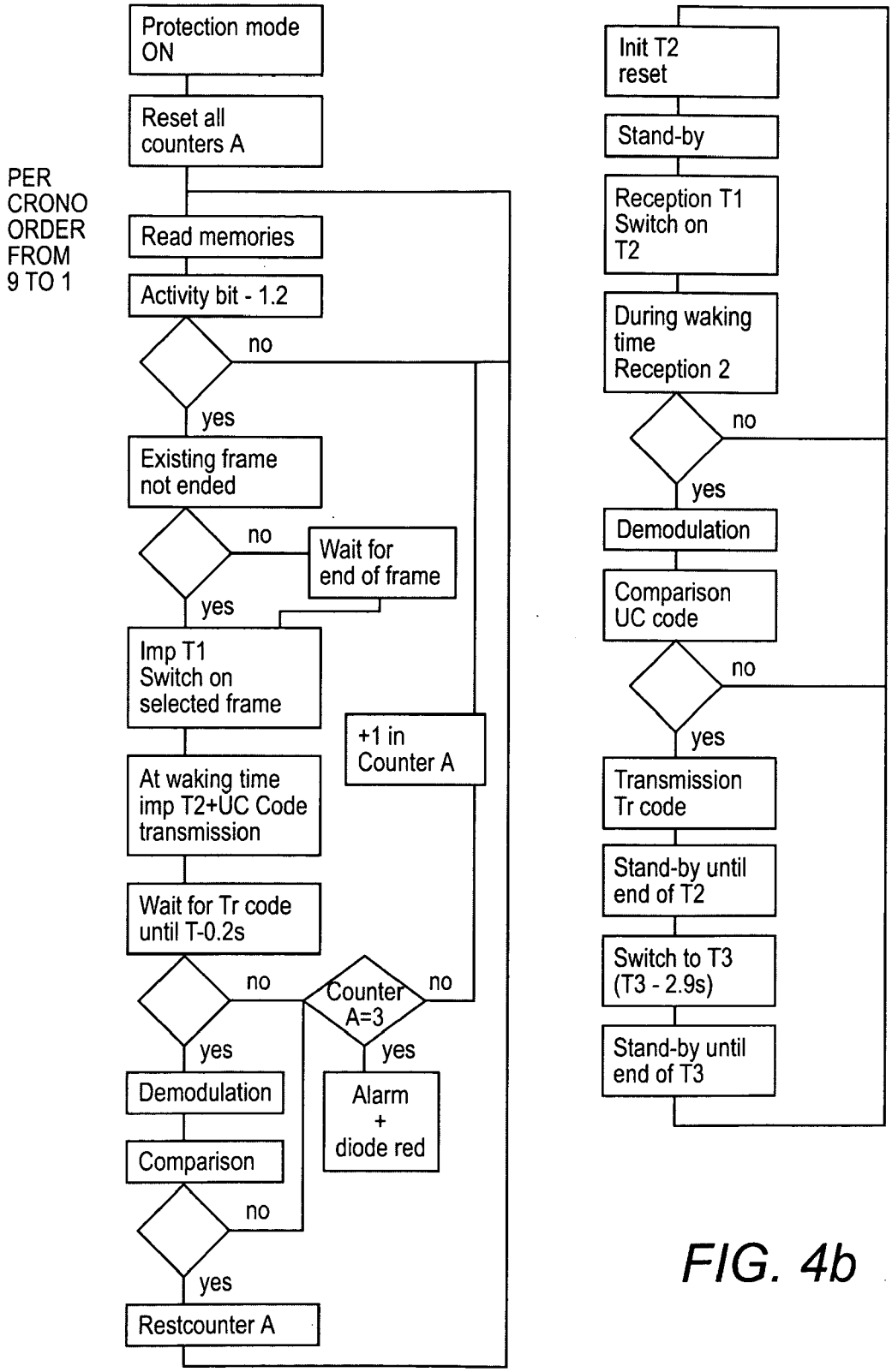
FIG. 4*b* is an illustration of an algorithm of the protection mode.
Figure 4C:
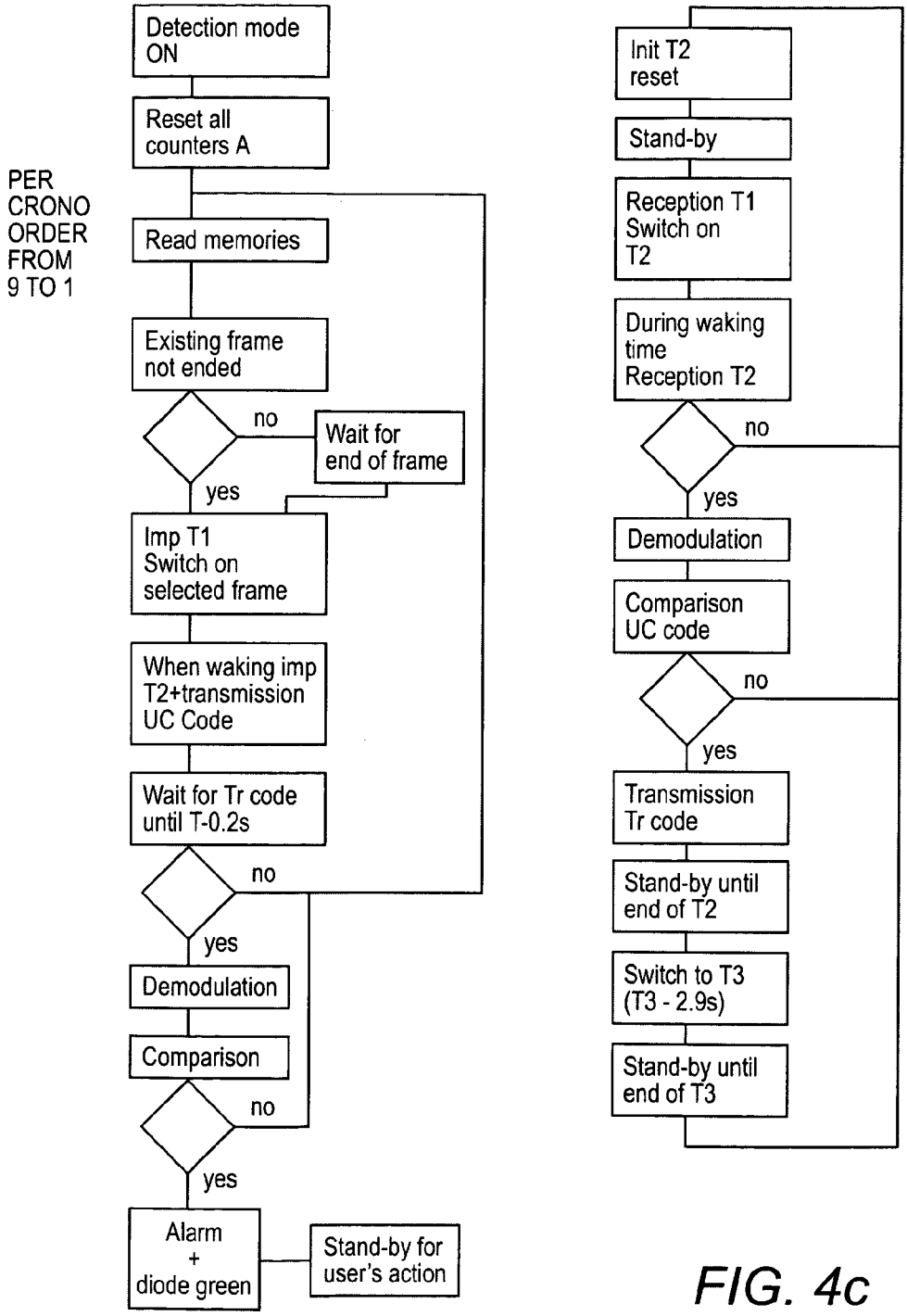
FIG. 4*c* is an illustration of an algorithm of the detection mode.
Figure 4D:
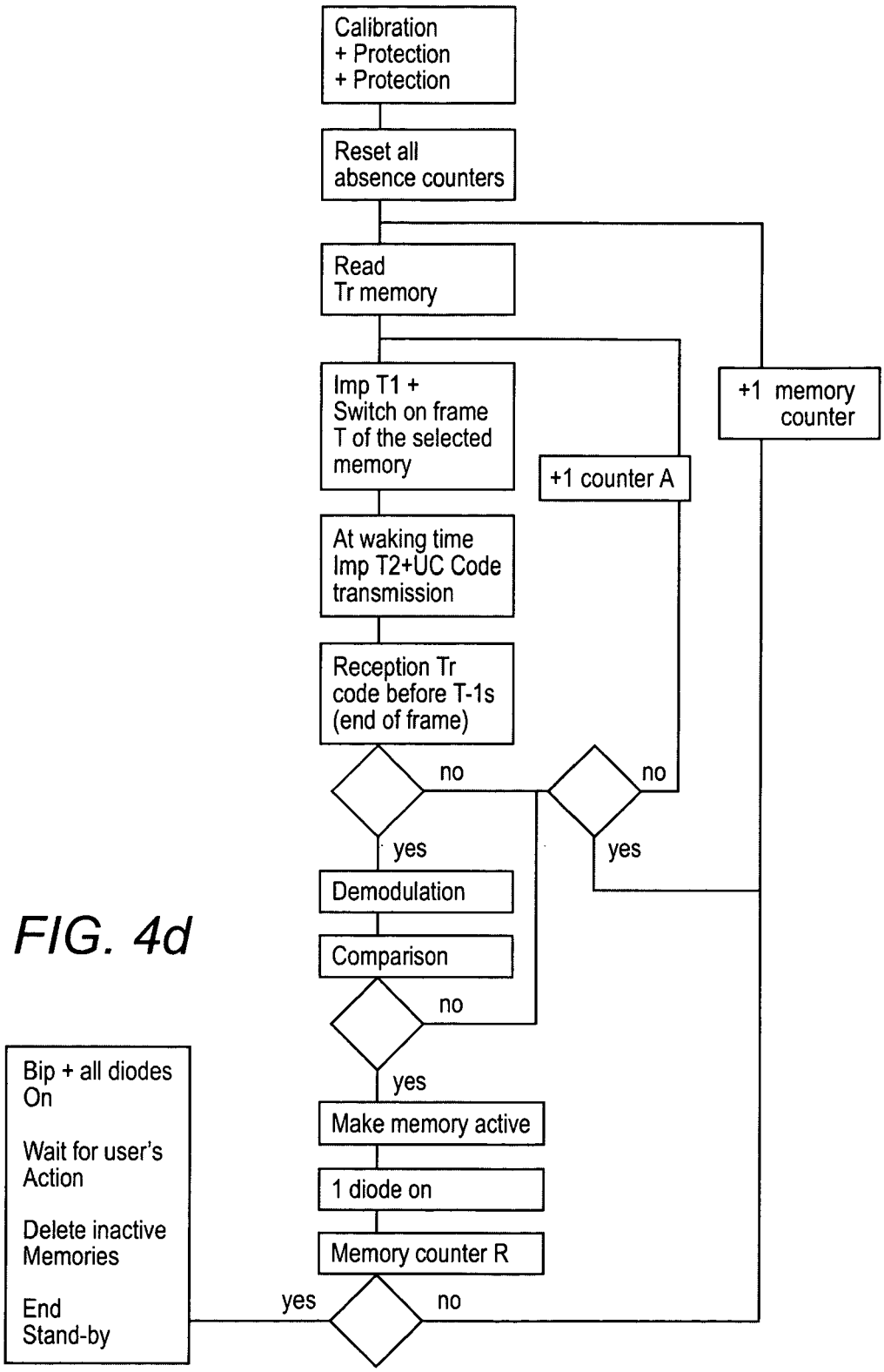
FIG. 4*d* is an illustration of an algorithm of the memory erasing mode.
Figure 4E:
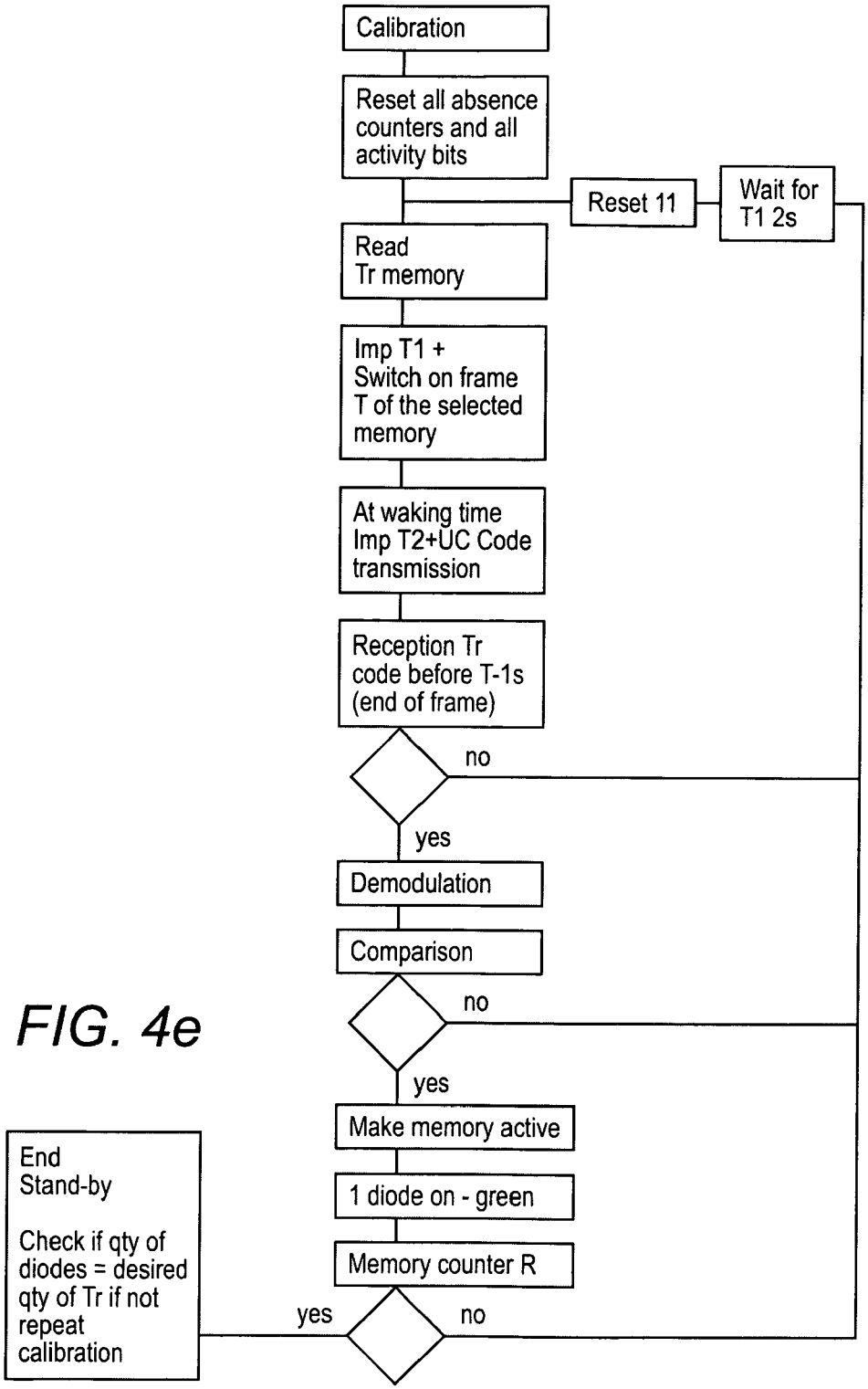
FIG. 4*e* is an illustration of an algorithm of the calibration mode.

The electronic sensor system, for monitoring presence in a defined volume, according to the present invention, works in three major operation modes which can be selected using the central unit 1:

a calibration mode in which the central unit queries successively on the basis of a given time interval all transponders 11 referenced in its memory 23, and stores for each queried and referenced transponder information, for example in the form of an activity bit set to "1", as shown in the FIG. 3, indicating the presence of the transponder 111 in the volume 12 to be monitored. Also in this figure, one can see that only transponders TR1, TR2, TR4 and TR7 have their activity bit set to "1". The user can verify the good functioning and the result of the calibration thanks to the LEDs 25. The selected transponders 11 will remain in memory until another calibration mode is effectuated, a protection mode in which the central unit 1 queries successively, in the order of memorization of the transponders 11 referenced in its memory 23 and on the basis of a given time interval, the transponders 11, where, among the referenced transponders TR1, TR2, TR4, and TR7, as shown in FIG. 3*a*, only the transponders TR1, TR2, TR4 and TR7 having an activity bit set to "1" are queried, and triggers the alarm 13 if one of the transponders whose activity bit is set to "1" does not respond through the transmission of a determined code, indicating its going out of the monitored volume 12, a detection mode in which the central unit 1 queries, according to the same principle as described above, all referenced transponders and triggers the alarm 13 for each response of a transponder and eliminates it from the interrogation loop, until the intervention of the user or until the detection of all referenced transponders has been effectuated, and two parameter setting modes, an initialization mode and a memory erasing mode.

The detection mode thus permits a user to locate a lost object and to avoid any risk of inserting a supernumerary transponder 11 for the purpose of a maleficent substitution or pirating of a referenced and calibrated transponder with the same encoding.

When referring to FIG. 3*b*, one can see an operating cycle of the device in the protection mode where, for the purpose of simplicity and comprehension, time is divided into seconds and tenths of seconds.

During the activation of the protection mode, the central unit 11 sends an impulse at 40 that simultaneously triggers the time counters 34 of each transponder TR1, TR2, TR4, TR7, then each time counter, after a defined interval varying from one transponder to another, activates at 41, for reception of the presence querying signal sent by the central unit 1. The corresponding transponder TR1, TR2, TR4 or TR7, if queried by the central unit while being awake, responds to the latter sending an encoded message 42 indicating its presence in the monitored volume. Then this transponder is automatically set in sleepy mode for a given interval 43 by means of the second time counter 34'. At the end of the sleep period, the transponders re-activate their counter 34 upon receipt of an impulse 44 from the central unit 1, then they awake at the end of the counter's counting and, if they receive, while awake, an impulse 46 from the central unit 1, they send back to it an encoded message 42 indicating their presence. Thus one can see, in FIG. 3*b*, that after the simultaneous awakening of all transponders TR1, TR2, TR4 and TR7 by means of an impulse 40 sent by the central unit 1, the transponder TR9 is last to be awakened, but first to be queried by the central unit 1. After which it transmits, in reply to the latter, an identification code 42, then it's the turn of the transponder TR4 to be queried by the central unit in order to verify its presence, then successively the transponders TR2 and TR1.

Also in FIG. 3*b*, one can see the presence of the initialization mode 47 in the beginning of the frame, during which all referenced transponders are in stand-by, so as to enable the insertion of new transponders into the memory 23' of the central unit 1.

The transponders can be integrated in an object to be protected, such as a chip card for banking applications, meeting the surface and thickness requirements, or can appear for example in the form of an independent electronic label that can be made integral, for example, through adhesion, with the object to be protected.

For an enhanced security of the device, communications between the central unit and the transponders are encrypted.

It should be noted that one could use an absence counter so that the central unit triggers its alarm only after n absences, thus avoiding untimely alarms.

The central unit can be integrated in an apparatus of the portable telephone type or the like and therefore be supplied with power by the battery of the latter.

I claim:

1. An electronic sensor system for monitoring activity of an object comprising:

a central electronic unit means;

at least one transponder means being interactive with said central electronic unit means; wherein said central electronic unit means exchanges encoded activity information through radio frequencies with the transponder means; and wherein said transponder means is associated with the object; and an alarm means being interactive with said central electronic unit means, wherein said central electronic unit directs said alarm means to emit an alarm upon receipt of selected encoded activity information from the transponder means;

wherein said transponder means has a stand-by mode and an active phase mode, said transponder means being selectively set in stand-by mode during operation of the system, and said central electronic unit means selectively corresponding with the transponder means and controlling said stand-by mode and said active phase mode of said transponder means;

a calibration means interactive with said central electronic unit means, said calibration means for monitoring activity of the transponder means within the defined volume and recording activity status of the transponder means in a memory of said central electronic unit means among a set of transponders referenced in said memory;

a protection means interactive with said central electronic unit means for querying successively in a loop the transponder means in said memory and for transmitting an activation signal to said alarm means if activity status of a transponder means is reported outside of pre-determined parameters;

a detection means interactive with said central electronic unit means for successively querying the transponder means in a loop and for triggering said alarm means at an instant when a transponder means responds with activity information outside of pre-determined parameters; and an initialization means interactive with said central electronic unit means for introducing additional transponders during a time period at a beginning of the querying of the transponder means, said initialization means for referencing the additional transponders into said memory, the identified transponder means being in said stand-by mode during said time period.

2. The system of claim 1, wherein said central electronic unit comprises a transmission/reception circuit, an interface comprising a buffer memory enabling radio-frequency connection between the central electronic unit and several transponders, a microcontroller, and memory storage containing the algorithms, in the form of computer programs, of the different modes of operation of the system, said microcontroller processing the encoded activity information from a transponder.

3. The system of claim 1, wherein said transponder means comprise a sensor means, a power source, a microcontroller and memory storage, a transmission/reception circuit and an interface comprising a buffer memory enabling connection with several controllers.

4. The system of claim 3, wherein said transponder further comprises a transmission/reception circuit and an intelligent memory capable, upon receipt of an impulse sent by the central electronic unit, of sending, via said transmission/reception circuit, an encoded information contained in its memory to the central electronic unit.

5. The system of claim 3, wherein said sensor means is comprised of an activity sensor, a motion sensor, a temperature sensor, an equilibrium sensor or a means for checking a presence of said transponder means in a defined volume.

6. The sensor system of claim 1, further comprising:

monitor means interactive with said central electronic unit means for informing a user of a state of operation of said central electronic unit means.

7. The sensor system of claim 1, the transponder means comprising:

a microcontroller;

a memory interactive with said microcontroller; and a transmission/reception circuit in communication with said central electronic unit means.

8. The sensor system of claim 1, the transponder means comprising:

a transmission/reception circuit; and a random memory means for sending an encoded information contained therein through said transmission/reception circuit to said central electronic unit means upon receipt of an impulse transmitted by said central electronic unit means.

9. The sensor system of claim 1, the transponder means comprising:

an electronic label suitable for being integrated into the object.

10. The sensor system of claim 1, said transponder means comprising a power source autonomous therein so as to supply power to said transponder means.

11. The sensor system of claim 1, said central electronic unit means for supplying power to said transducer means.

12. The sensor system of claim 1, said encoded activity information being encrypted.

13. The sensor system of claim 1, further comprising:

an absence counter means interactive with said central electronic unit means for triggering said alarm means when said transponder means reports encoded activity information outside of pre-determined parameters.

* * * * *